United States Patent [19]

Nichols et al.

[11] Patent Number: 4,720,013

[45] Date of Patent: Jan. 19, 1988

[54] NESTABLE AND STACKABLE TRAY

[75] Inventors: Glenn R. Nichols, Wyoming; Michael F. Stejskal; Robert M. Zink, both of Holland, all of Mich.

[73] Assignee: Bradford Company, Holland, Mich.

[21] Appl. No.: 901,021

[22] Filed: Aug. 28, 1986

[51] Int. Cl.[4] ..... B65D 21/06

[52] U.S. Cl. ..... 206/506; 229/915

[58] Field of Search ..... 206/506, 503, 505; 229/915, 916, 917, 918, 919, DIG. 11

[56] References Cited

U.S. PATENT DOCUMENTS

| | | | |
|---|---|---|---|
| 1,689,217 | 10/1928 | White . | |
| 2,307,146 | 1/1943 | McCash et al. . | |
| 2,312,662 | 3/1943 | Miller . | |
| 2,528,551 | 11/1950 | Ross | 206/506 |
| 2,588,455 | 3/1952 | Adams | 229/915 |
| 2,765,099 | 10/1956 | Lively . | |
| 2,771,232 | 11/1956 | Reed . | |
| 2,782,936 | 2/1957 | Lockwood . | |
| 2,868,429 | 1/1959 | Shanahan . | |
| 2,940,602 | 6/1960 | Lockwood . | |
| 3,169,659 | 2/1965 | Blackmore . | |
| 3,648,909 | 2/1972 | Wisecarver | 206/506 |
| 3,800,939 | 4/1974 | Cornelius | 206/506 |
| 3,840,115 | 10/1974 | Ladewig . | |
| 3,935,990 | 2/1976 | Crane | 229/915 |
| 4,163,495 | 8/1979 | Drader | 206/506 |
| 4,304,351 | 12/1981 | Stollberg | 229/915 |

FOREIGN PATENT DOCUMENTS

| | | | |
|---|---|---|---|
| 103388 | 8/1962 | Denmark | 220/DIG. 11 |
| 1579535 | 11/1980 | United Kingdom . | |
| 2081224 | 2/1982 | United Kingdom | 206/506 |

*Primary Examiner*—George E. Lowrance

*Attorney, Agent, or Firm*—Wood, Herron & Evans

[57] ABSTRACT

A nestable and stackable tray preferably formed of molded or die cut flat sheet material having a pair of stacking supports pivotally attached to the inside of the tray near the bottoms of each of the end walls of the tray. The supports are movable to a lowered position against the base of the tray for nesting empty trays within one another and for holding the trays in close spaced relationship while nesting. The supports are also movable to a raised position against an end wall of the tray and held against the walls with fasteners, where the supports present an upper surface upon which another tray is placed for stacking the loaded trays one upon another.

12 Claims, 11 Drawing Figures

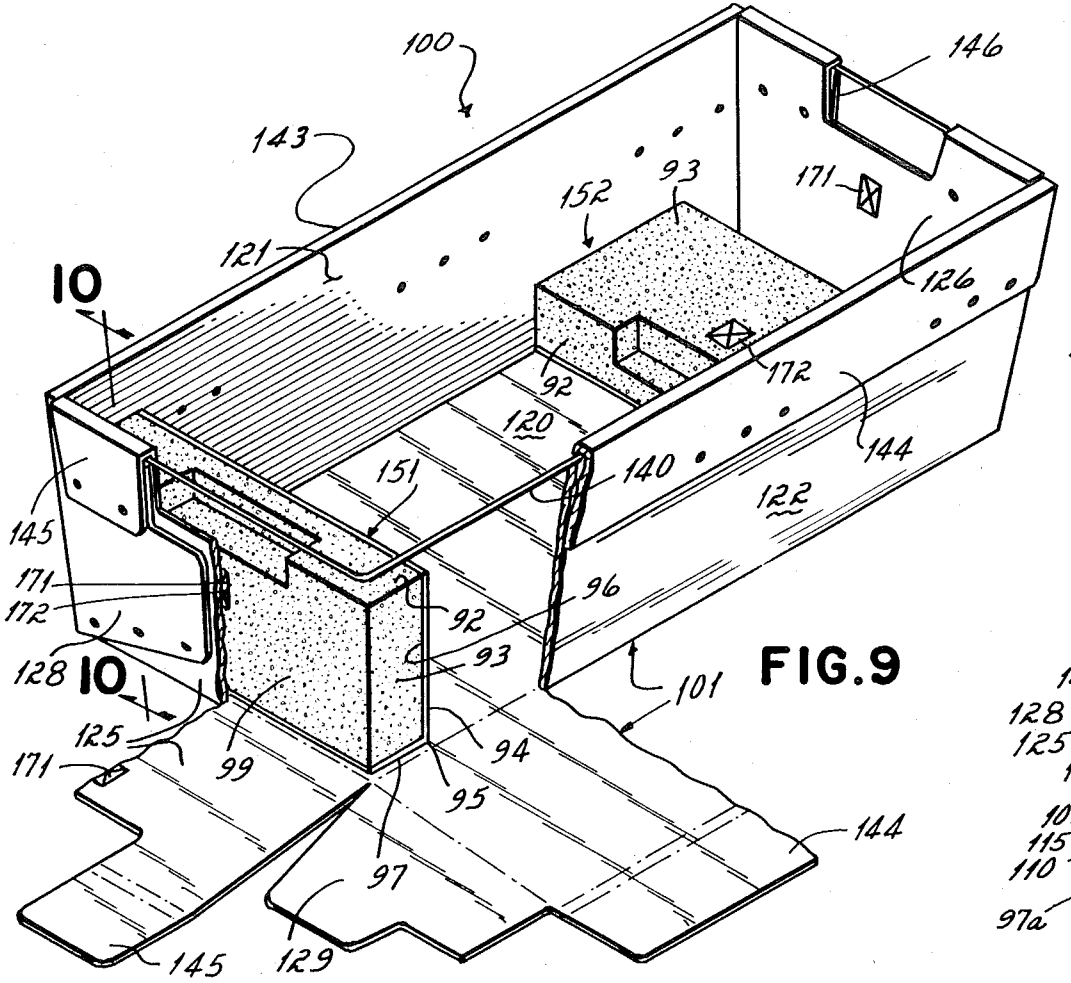
FIG. 10
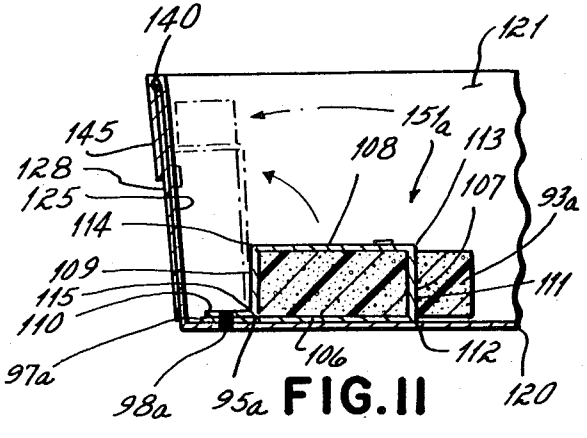
FIG. 11
FIG. 9

NESTABLE AND STACKABLE TRAY

The present invention relates to nestable and stackable open-top containers or trays and more particularly to reusable open-top trays capable of being stacked upon each other when loaded without bearing upon the contents, and capable of being deeply nested with each other when empty for return to the source.

The need for containers in the shipment, handling and storage of parts and products in industrial, agricultural and retailing applications has caused continuous attention to be placed on the costs associated with the manufacture and the handling of these containers. The provision of reusable containers has been a widespread practice for reducing the average cost of each use of the containers. Reusable containers have become increasingly practical with the increased use of continuous processes where resupply of parts or products must immediately follow their use and the contemporaneous availability of an empty container caused by that use.

In addition, the use of open-top, box-like containers or trays provides for more efficient and economical handling than the use of containers with lids.

The use of reusable trays or totes in industrial and other applications in most cases requires that these trays possess two characteristics. First, shipping and storage dictaTe that the trays be stackable when loaded. Second, reusability can require that the trays be nestable one within the other when empty to reduce the cost of returning the trays for reuse, and the cost of storage before reuse.

For empty open-top trays to be nestable one within the other, the prior art has routinely provided for trays to be formed with a rectangular base and four upwardly extending and outwardly tapered walls surrounding the base so that the upper rim of the tray is wider than the base to allow the similarly shaped trays to deeply nest one within the other when stacked upon each other when empty. The provision of this very design, however, renders difficult the stacking of the trays when they are loaded. The stacking of loaded trays thusly shaped will subject the load of the upper tray presented by its base to be directed upon the contents of the lower tray. This results in compression or crushing of the contents, as well as an unstable stacking arrangement.

Designs have been proposed by the prior art to allow the trays to be reconfigured for stacking and nesting by providing the trays with various movable structures to serve as stacking supports to bear the load of the upper tray in a stacking arrangement and to protect the contents of the lower tray. The prior art designs have provided trays with stacking supports which move into the path of the downwardly resting upper tray to support it in a stacking relationship. The structures have, in some proposals, been hinged to the upper edges of the tray walls or have been designed so as to be formed from inward deformation of the corners of the tray walls. Other proposals have provided rigid structural attachments which are utilized of stacking purposes by their movement or by a repositioning of the tray so as to present it in a position to support another tray stacked upon it.

The designs of the prior art have resulted in some loss in the economy of manufacture of the trays or of added cost due to inefficiencies introduced in the use and handling of the trays themselves. Furthermore, the designs of the structures proposed by the prior art have in many cases required that the containers or trays be manufactured from materials of greater strength and greater cost, because the containers themselves must provide the stacking strength.

In addition, it has been learned from experience that one of the more cost efficient and desirable methods of fabricating trays for this purpose has been to mold or die cut the trays from sheet material. Plastic and paper materials, particularly corrugated plastic and corrugated paperboard materials, as well as solid plastic and solid paperboard materials have been found to be economical and satisfactory materials for containers of this type.

It is a principal objective of the present invention to provide an open-top, tray-like container or tote which can be easily and efficiently converted between a stacking configuration when loaded and a nesting configuration when empty.

It is a more particular objective of the present invention to provide a reusable tray or tote which can be stacked or unloaded and nested when empty, and efficiently manufactured from economical and suitable material.

It is a more specific objective of the present invention to provide a reusable tray or tote which is nestable, as well as stackable, and which is provided with a movabel support capable of adapting the trays for stacking when loaded, for adapting the trays for nesting when empty, and for nesting in such a way as to minimize the binding of the trays together in the nested relationship.

According to the practice of the present invention, a reusable stackable and nestable tray is molded or fabricated from one or more pieces of paperboard or plastic material. In the preferred embodiment, the tray is fabricated from a corrugated material such as corrugated plastic. The tray is shaped in the nestable configuration with rectangular base and upwardly and outwardly tapered walls. Pivotally secured to the inside of the tray near the base of the walls is provided at least one, and preferably a pair, of movable supports. The supports are pivotal between two positions. The first position is a raised position against a wall of the tray to present at its top when so raised an upward load bearing surface for supporting another tray to be stacked thereupon. The raised supports provide the stacking strength, protecting the tray and its contents from compression or crushing. The second position of the supports is a lowered position against the bottom of the tray to accommodate a nesting of the trays one with another and presenting an upper surface when so lowered which maintains the nested trays in a close nested relationship but free of binding one with another. More specifically, the preferred embodiment of the present invention provides a tray fabricated out of paper or plastic material which is molded or die cut, folded, and fastened in the appropriate tray design. Multiple supports are provided which pivot between the stacking and nesting arrangements and which in one preferred embodiment can be fabricated, at least in part, out of an extension of one or more of the pieces of material which form the base or walls of the tray. A fold in the material constitutes the pivotal joint or hinge. As illustrated in one of the preferred embodiments which has been found to be suited for many applications, the pivotal support is folded into a closed shape or block which could be rectangular, but is preferably triangular in shape and which is configured so as to present one side as the upper load bearing surface when the support is upright for the stacking of the trays and to provide another tray supporting surface to support the trays in spaced relationship for nesting.

In an illustrated alternative embodiment, the support is in the form of a solid block, for example, a styrofoam block, which may be hinged to the interior tray surface through an extension of the sheet material out of which the base or a wall is formed. In addition, the illustrated preferred embodiments of the present invention are provided with some fastening means which hold the movable supports in the raised positions against the walls of the tray when the support is raised for loading or stacking of the tray, with the support resting by gravity against the bottom of the tray when the trays are empty and configured to be nested one with another.

These and other objectives and advantages of the present invention will be more readily apparent from the following detailed description of the drawings illustrating the preferred embodiments of the present invention:

FIG. 9 is a partially broken away and unfolded perspective view of an alternative embodiment of the present invention in which the base and the four walls of the tray are formed of a single piece of die cut sheet material and employing solid block supports hinged near the base of the end walls of the tray.

FIG. 10 is a cross-sectional view of one of the supporting blocks taken along line 10—10 of FIG. 9 showing one method for securing the block to the tray.

FIG. 11 is a view similar to that of FIG. 10 showing an alternative configuration of the hinging supporting block and a different method of securing the block and hinged sheet together.

Figure 1:
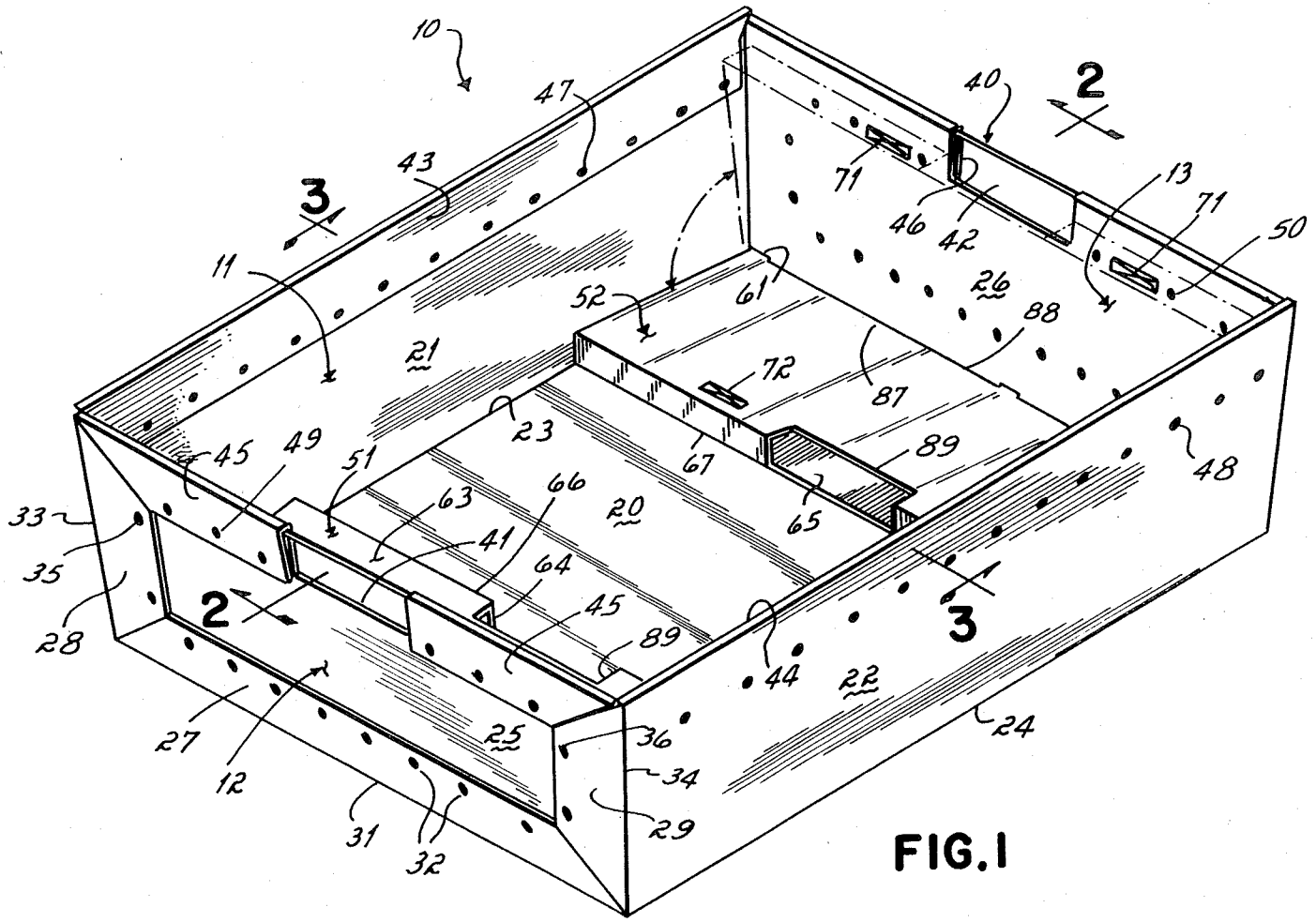
FIG. 1 is a perspective view of a preferred embodiment of a nestable, stackable tray, according to the principles of the present invention, particularly of an embodiment formed of three pieces of die cut material.

Referring to FIG. 1, a nestable/stackable tray 10 embodying principles of the present invention is shown. According to this illustrated embodiment of the present invention, the tray 10 is formed of three pieces of die cut sheet material 11, 12 and 13. The manner in which these pieces 11, 12 and 13 are formed into the tray illustrated in FIG. 1 will be more readily appreciated in connection with the description of FIGS. 6, 7 and 8 below. In the embodiment shown, these pieces are preferably die cut from sheets of corrugated thermoplastic material, Other materials, though, such as corrugated paperboard, solid plastic or solid paperboard could as well though be used to form the tray.

The tray 10 comprises a rectangular base 20, and a pair of side walls 21 and 22, each formed of the piece of sheet material 11. The side walls 21 and 22 are differentiated from the base 20 by folds 23 and 24, respectively, which define the opposite side edges of the base 20 and the bottom edges of the side walls 21 and 22. The tray 20 also includes a pair of end walls 25 and 26 which are formed of the pieces of sheet material 12 and 13, respectively. The end walls 25 is secured to the base 20 and side walls 21 and 22 at flaps 27, 28 and 29, respectively. The base flap 27 is folded around the end edge 31 of the base 20 and is welded at spots 32 to the end wall 25. The flaps 28 and 29 are folded around the wall corners 33 and 34, respectively, and welded at spots 35 and 36, respectively, to the end wall 25. Similarly, the opposite end wall 26 is secured by spot welding at spots 32, 35 and 36 to similar flaps (not shown) in the base 20 and side walls 21 and 22, respectively.

A rim reinforcement rod 40 in the form of a closed rectangular loop is provided to reinforce the upper edge of the tray walls and to serve as a tension ring holding the walls together at the corners. The rod 40 also serves as a handle in each of two handle cut regions 41 and 42, respectively, in the side walls 25 and 26. The wire rod 40 is secured to the top edge of the tray walls by flaps 43, 44, 45 and 46 in the walls 21, 22, 25, and 26, respectively. The flaps 43 and 44 are folded inwardly over the wire rod 40 at the side walls, while the flaps 45 and 46 are folded outwardly over the wire rod 40 at the end walls 25, 26. The flaps 43, 44, 45 and 46 are welded to the respective walls 21, 22, 25 and 26 at spots 47, 48, 49 and 50, respectively.

The four tray walls 21, 22, 25 and 26 extend upwardly from the base 20 and taper outwardly diverging from each other as they rise from the base 10. Accordingly, the upper rim of the tray at the walls is larger than, and surrounds, the outer edges of the base 20. Thus, when empty, trays 10 of this type are nestable one within the other.

The tray 10 is further provided with a pair of stacking supports 51 and 52. The supports 51 and 52 are pivotally attached at the bottoms of the end walls 25 and 26 on the inside of the tray 10. The support 51 is integrally formed of the sheet 12 of which the end wall 25 is constructed. The support 51 is illustrated in FIG. 1 in the raised or tray stacking position. Similarly, the support 52 is integrally formed of the piece of sheet material 13 of which the end wall 26 is formed. In FIG. 1 the support 52 is illustrated in the lowered position against the base 20 for nesting of the trays 10. The construction and use of the supports 51 and 52 in the preferred embodiment shown in FIG. 1 is better understood with reference to FIGS. 2 through 5.

Figure 2:
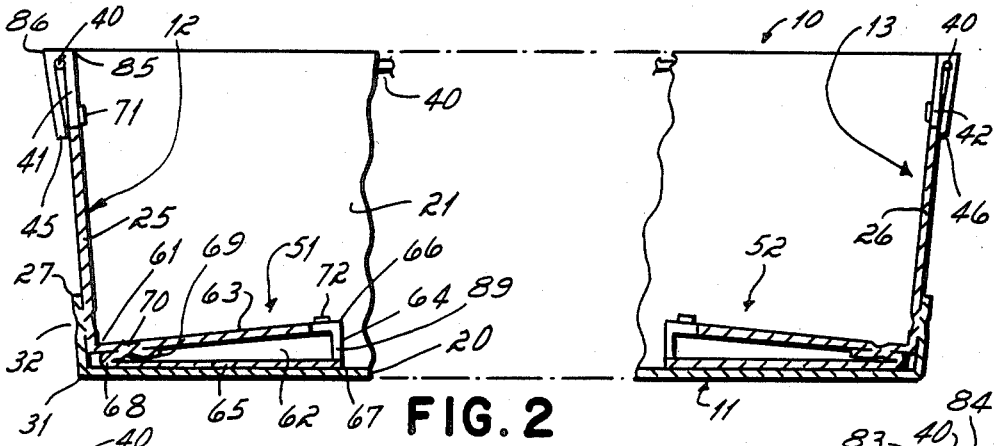
FIG. 2 is a cross-sectional view taken along line 2—2 of FIG. 1 showing the supports in the lowered position for nesting of the trays.

FIG. 2 shows a cross-sectional view through the tray 10 illustrating the base 20 formed of the sheet 11, the end wall 25 and a support 51 formed of the piece of sheet material 12, and the end wall 26 and support 52 formed of the piece of sheet material 13. In FIG. 2, the flap 27 of the sheet 11 is shown welded at spot 32 to the sheet 12. The flap 45 of the sheet 12 is shown folded outwardly over the wire reinforcement rod 40. Similarly, the sheet 13 is so secured to the base 20 and over the rod 40.

In FIG. 2, the support 51 is shown formed integrally of the piece of sheet material 12. The support 52 is similarly formed integrally of the piece of sheet material 13. Thus, the following description with respect to support 51 is applicable to support 52. Support 51 is pivotally secured to the bottom of the end wall 25 at a fold 61 in the sheet material piece 12. The sheet material 12 is folded into a closed loop 62, preferably a triangle, defined by the surfaces 63, 64 and 65. The sides of the loop 62 are separated by the folds 66 and 67. The loop 62 is closed by a 180° fold 68 at the end of the surface 65 defining an end flap 69 welded to the underside of the surface 63 at the spot 70.

In the lowered position shown in FIG. 2, the support 51 is pivoted downward so as to rest by its surface 65 against the base 20 of the tray 10. In this position the surface 64 supports the surface 63 above the base and presents a load bearing surface for the nesting of additional trays on top. The surface 64 maintains the load bearing surface 63 in a spaced relationship with the base 20 so as to maintain a predetermined amount of separation between the bases of the trays when nesting. The separation guards against unwanted binding of the tapered walls of the trays one within another caused by nesting too deeply.

Also in FIG. 2 is shown a Velcro fastener comprised of conventional hooked and looped parts 71 and 72 attached one 71 near the top of the end wall 25 on its inner surface and the other 72 near the top of the surface 63 of the support 51. When the support 51 is moved by pivoting about the fold 61 to a raised position for stacking of the trays 10, the fastener parts 71 and 72 join and lock to hold the support 51 against the end wall 25 so that the support 51 does not inadvertently fall with gravity during the course of the loading of the tray and so that the support 51 stays in place during stacking to provide a sturdier and more reliable stacking arrangement. This will be explained more fully below in connection with the description of FIG. 5.

Figure 3:
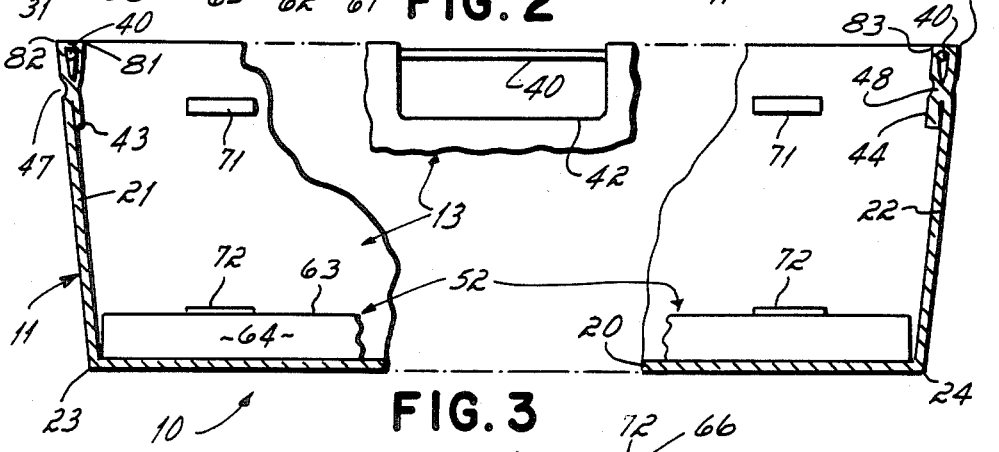
FIG. 3 is a cross-sectional view taken along the line 3—3 of FIG. 1 showing the supports in the lowered position.

Referring now to FIG. 3, the section of the tray 10 through the side walls 21 and 22 is shown illustrating the support 52 in the lowered or tray nesting position as was illustrated in FIG. 2. The positions of the Velcro fasteners 71 and 72 are shown glued to the end wall 26 and support 52, respectively. The sheet 11, of which is formed the base 20, and the folded edge 23 which differentiates the base 20 from the side wall 21, and the fold 24 which differentiates the base 20 from the side wall 22, are shown more clearly in this Figure. At the tops of the respective side walls 21 and 22 are shown in section the flaps 43 and 44 folded over and welded at spots 47 and 48 about the wire rim reinforcement rod 40. As further shown in FIG. 3, the wire rod 40 forms a handle for the tray 10 at a section exposed by cutaway portion 42 in the upper edge of the end wall 26.

Figure 4:
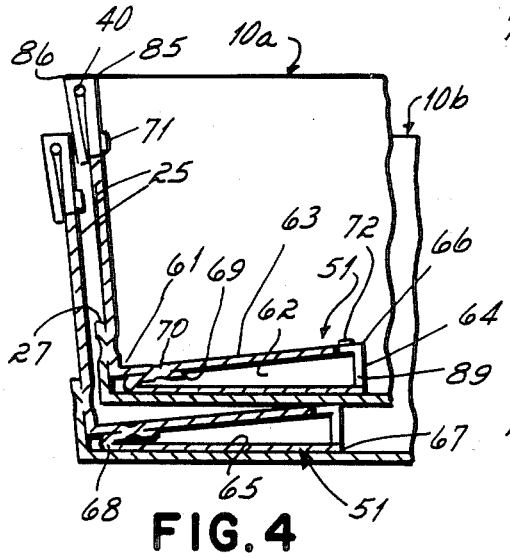
FIG. 4 is a drawing similar to that of FIG. 2 showing two trays in nested relationship.

FIG. 4 shows the cross sections of two trays as described in FIG. 2 while in nesting relationship. In FIG. 4 an upper tray **10*a* is illustrated as nested within the lower tray 10*b*. In nesting, the lower support 51 rests against the bottom or base 20 of the lower tray 10*b*. The base 20 of the upper tray 10*a*, when nested with the lower tray 10*b*, engages and bears down upon the support 51 and particularly the supporting surface 63 of the support 51. The end surface 64 reinforces and holds the surface 63 in spaced relationship above the base of the lower tray 10*b* to maintain a certain spacing with respect thereto by the upper tray 10*a*, the spaced relationship preventing the end walls 25 of the respective trays 10*a* and 10*b*** from being wedged against each other and binding together when a large number of trays are nested and the weight of the nested trays bears heavily upon these near the bottom of the nest.

Figure 5:
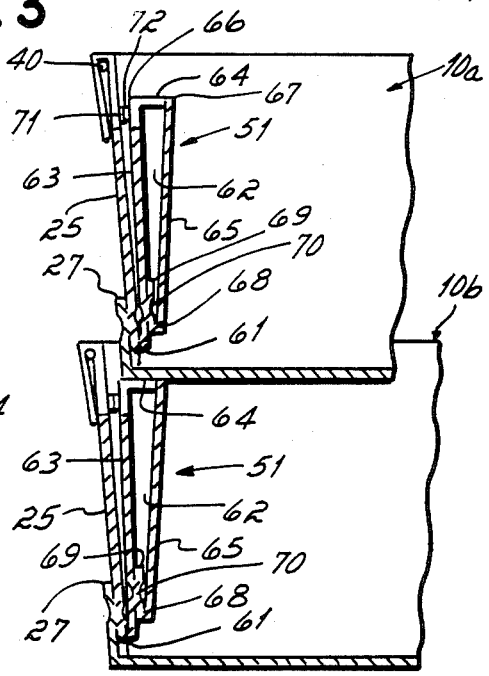
FIG. 5 is a drawing similar to the drawing of FIG. 4 showing the supports instead in the raised position and two trays in stacked, rather than nested, relationship.

FIG. 5 in turn illustrates the trays **10*a* and 10*b* in a stacked, rather than a nested, relationship. When positioned for stacking, the support 51 is raised such that its surface 63 is held against the end wall 25 by the Velcro fastener parts 72 and 72. The closed triangular loop 62 of the support 51 forms a strong triangular shelf presenting an upper support surface 64 against which the base 20 of the upper tray 10*a* rests. Stacked in this manner, the load of the tray 10*a* and of trays stacked thereabove upon the tray 10*b* is borne by the support 51, and the contents of tray 10*b*** are thereby protected from crushing or deformation due to the compressive loads from the trays above.

Figure 6:
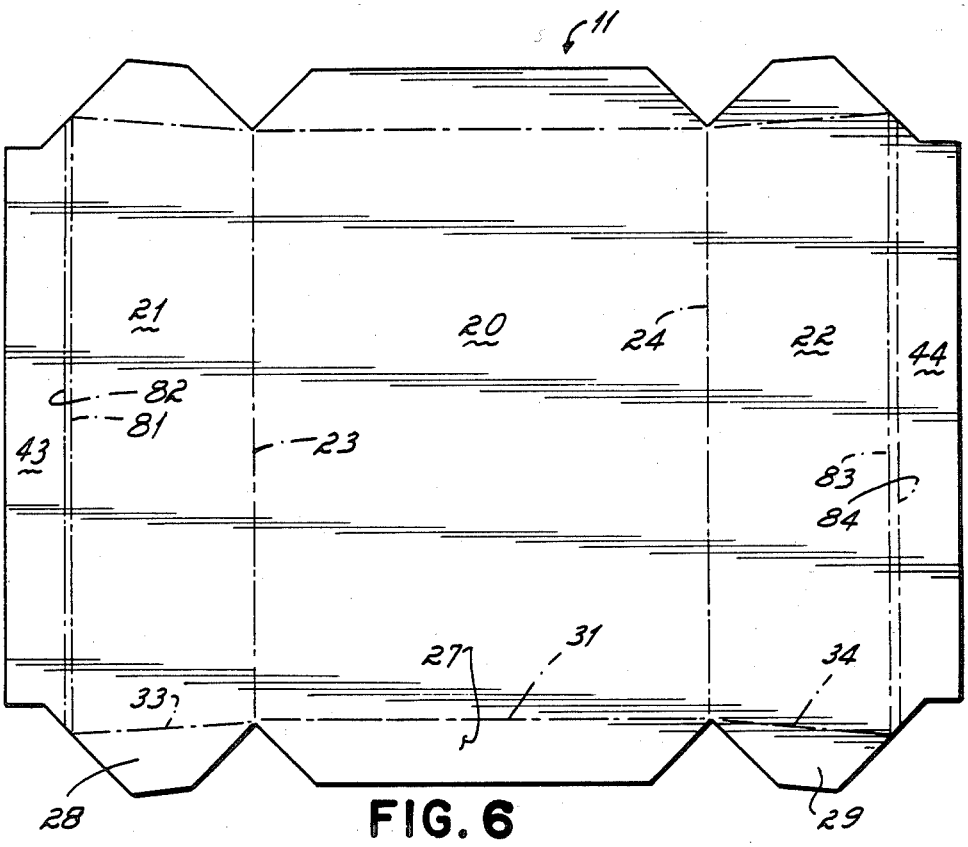
FIG. 6 is a plan view of one piece of die cut sheet material formed into a blank for constrution of the base and side wall portions of the tray illustrated in FIG. 1.
Figure 7:
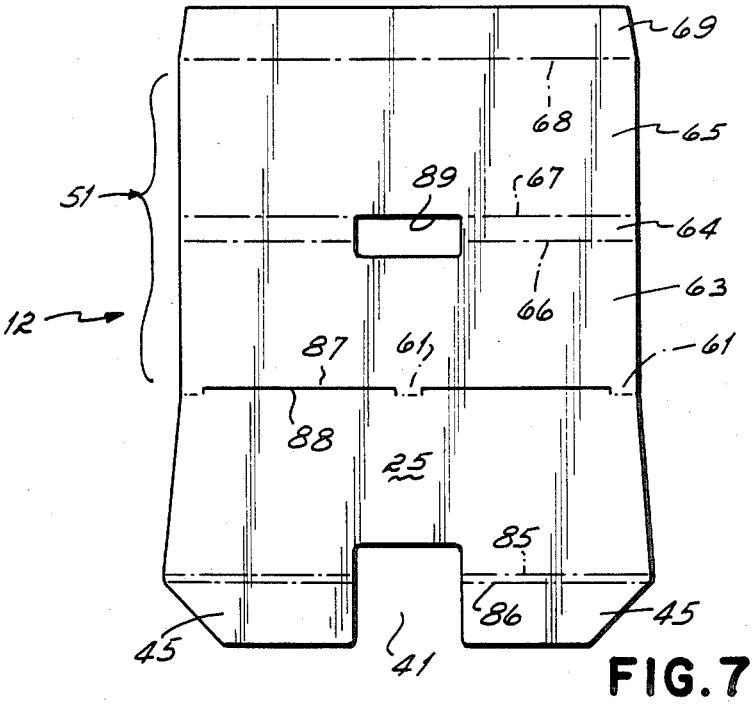
FIG. 7 is a plan view of a piece of die cut sheet material formed into a blank for the construction of either one of the two end walls and with the supports integrally formed of the same piece.
Figure 8:
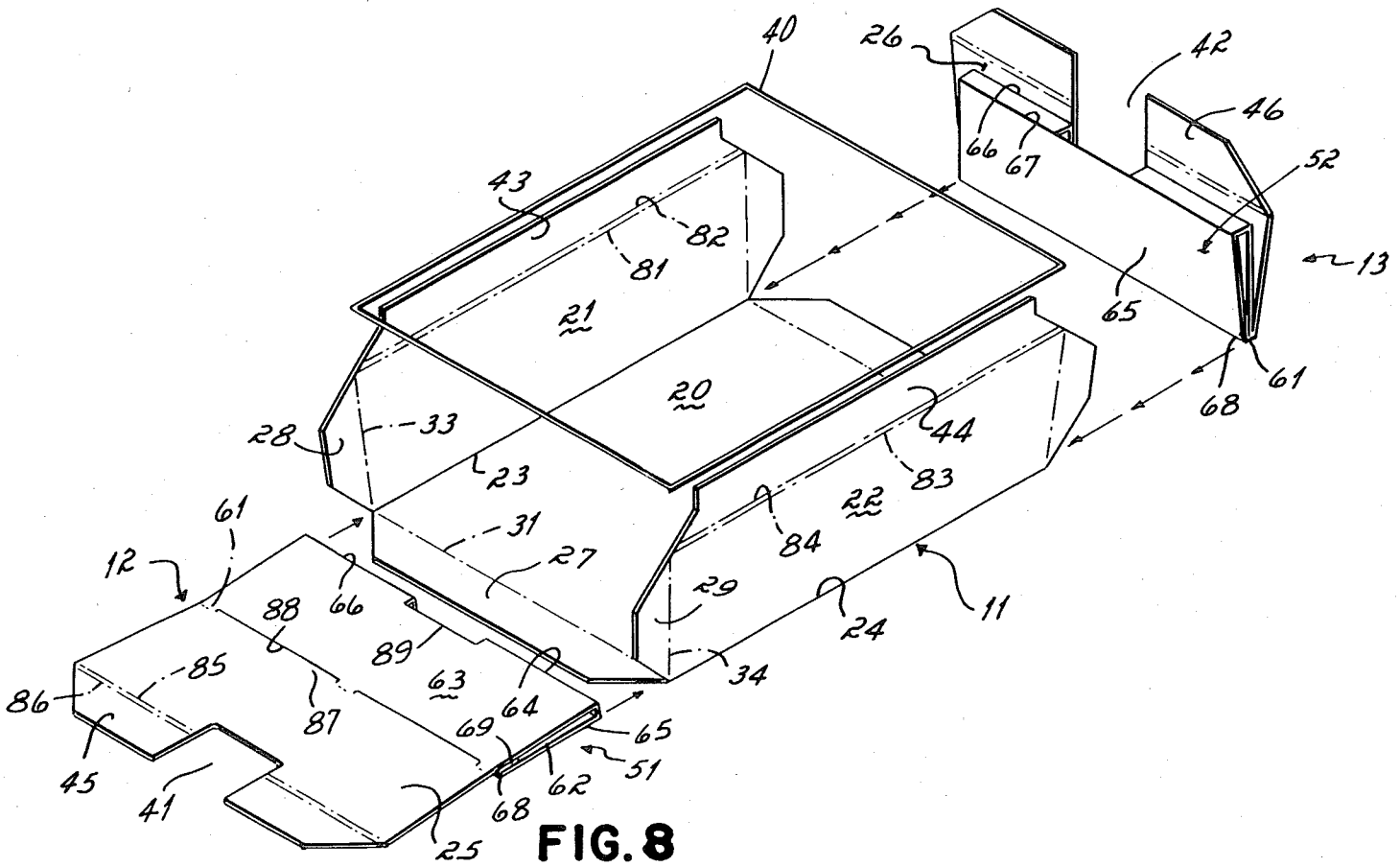
FIG. 8 is an exploded perspective view of the tray of FIG. 1 showing separately the three pieces of sheet material, including one of those illustrated in FIG. 6 and two of those illustrated in FIG. 7, as well as a wire rim reinforcement, which constitute the components of the box of FIG. 1.

The die cut sheet construction in three pieces of the preferred embodiment illustrated in FIGS. 1–5 is more completely illustrated in FIGS. 6–8. Referring to FIG. 6, the largest piece 11 of sheet material, in this case corrugated plastic sheet material, is shown die cut to the shape required for assembly of the box 10. The sheet 11 is formed by folding along the fold lines illustrated by the broken lines in FIG. 6. The sections of sheet 11 include the rectangular base 20 bounded by the edge corners 23, 24, 31 and 32. The fold 23 separates the base 20 from side wall section 21, which is in turn separated by a pair of aligned folds 81 and 82 from the top flap 43. Fold 31 differentiates the flap 27 from the base 20 and similarly folds 33 and 34 differentiate the flaps 28 and 29, respectively, from the side walls 21 and 22. The flaps 27, 28 and 29 are for attachment to sheet 12 which forms the end wall 25 of the box 10. Similarly, on the opposite edge of the sheet 11 are flaps identical to flaps 27, 28 and 29 for attachment to the end wall 26 formed by the sheet 13 (FIG. 8). In a manner similar to the formation of flap 43, flap 44 is differentiated by the folds 83 and 84 from the side wall 22.

Referring to FIG. 7, the blank of the die cut piece 12 out of which the end wall 25 and support 51 are formed is shown. This blank is identical to the blank 13 from which the end wall 26 and support 52 are formed and accordingly, only one description, that of sheet 12, is presented. The blank 12 includes the end wall portion 25 which is differentiated by a pair of folds 85 and 86 from the flaps 45 which wrap around the rim rod 40 at the top edge of the tray 10. Interrupting the flap 45 is a cutout 41 which forms the handle region. Near the bottom of the end wall 25 is an edge region 87 at which the pivotal link 61 for securing the support 51 to the end wall 25 is shown. At the edge 87, the pivotal connection between the support 51 and end wall 25 is formed by the fold 61 in the sheet 12. To reduce the stiffness of this fold to allow the support 51 to pivot more freely, a pair of slots 88 are provided in line with the fold 61. Immediately adjacent the upward facing fold 61 is the surface 63 of the support 51, the surface upon which will be supported another tray when nested within the tray 10. The surface 63 also rests against the surface of the end wall 25 when the support 51 is in the raised position for the stacking of the trays. The surface 63 is differentiated from the surface 64 by the fold 66, which is downward and on the opposite side of the sheet from that of the fold 61. Similarly, the surface 64 is differentiated from the surface 65 by the downward fold 67. The surface 65 forms the lower surface which rests against the sheet 11 (FIG. 6) when the support is in the lowered position for the nesting of the trays. Finally, the end flap 69 is also differentiated by a downward fold 68 from the surface 65. The flap 69 is that which is wrapped down under and secured through thermal welding or other means to the back of the surface 63 near the fold 61 in the region of the base edge 87. In the center of the surface 64 in the support 51 is a die cut hole 89 which corresponds to the handle hole 41 to avoid interference in the carrying of the tray when the support 41 is in the raised position.

Referring to FIG. 8, the pieces of sheet material 11, 12 and 13 are shown in a preassembled relationship. The sheet 11 is shown with the rectangular base 20 disposed horizontally and from which are folded the side walls 21 and 22. The flaps 27, 28 and 29 of the sheet 11 are folded therefrom to engage the end wall 25 in the sheet 12. Pivotally attached at the bottom of the wall 25 in the sheet 12 is a support 51 differentiated from the end wall 25 at the fold 61. Similarly, sheet 13 is formed to constitute the end wall 26, support 52 and upper flap 46. Upper flaps are folded in the sheet material, including the flaps 43, 44, 45 and 46, which are adapted to fold around the loop over the metal rim reinforcing rod 40 around the top of the tray 10. When so assembled, the completed structure is that illustrated in FIG. 1.

An alternatvie embodiment illustrated in FIG. 9 shows a tray 100 formed of a single piece of sheet material. The tray of FIG. 9 is formed from a single piece of sheet material 101. In this sheet 101, the five main surfaces corresponding to the parts of tray 10 of the embodiment shown in FIG. 1 are formed. These include the base 120, the side walls 121 and 122, and the end walls 125 and 126. The wire rim reinforcing rod 140 is the same as in the embodiment of FIG. 1. The rod is encased at the top edges of the four walls by flaps 143, 144, 145 and 146 folded in the respective walls of the tray. End flaps 128, 129 corresponding to flaps 28 and 29 fold around the corners of the tray and upon the sheet 101 to form the bond between the side walls 121 and 122 and the end walls 125 and 126.

The supports 151 and 152, instead of being formed of closed loops of the sheet material which form the end walls as in FIG. 1, are formed of a combination, foam plastic block 93 and a corrugated plastic sheet 94. The sheet forms the pivotal hinged joint between the support 151 at the bottom of the end wall 125 and corresponds to the side 65 in the previously described embodiment. This pivotal connection is formed by a fold in the corrugated plastic sheet material 94 designated at 95. The construction of the support 151 is better illustrated in more detail by reference to FIG. 10. There is shown the support 151 which comprises the foam block 93 glued to the upper side 96 of the sheet 94. A flap 97 in the sheet 94 is differentiated from that surface 96 by a fold 95. The flap 97 is welded to the base 120 of the tray 100 at spot 98. In FIG. 10 the block support 151 is shown in the lowered position with the sheet 94 resting against the base 120. The foam block 93 thus presents an upper surface 99 (corresponding to surface 63 in the previous embodiment) which supports the base of another tray stacked upon the tray 100 when the trays are in nested relationship. In such a nested relationship, the block 93 provides the degree of spacing which prevents the tapered walls 121, 122, 125 and 126 of the tray 100 from binding. The support in the raised position is shown by the phantom lines in FIG. 10. In this position, the block 93 presents an upper surface 92, corresponding to the surface 64 in previously described embodiments, which supports the bases of other trays stacked upon the tray 100 when the trays are in stacked relationship with each other. In this position, the support 151 is held against the insides of the end wall 125 by the Velcro connector set 171 and 172. The block 93 in the embodiment shown in FIG. 10 is retained to the surface 96 by glue.

As a variation of the embodiment shown in FIG. 10, FIG. 11 illustrates a supporting block **151*a* in which the sheet material surrounds or forms a belt around a portion of the block 93*a* and secures it to the bottom wall 120. The encasing sheet material has a bottom wall 106, a relatively narrow vertical wall 107, a top wall 108, a second vertical wall 109 and a flap 110. The narrow vertical wall 107 passes through a slot 111 in the supporting block 93*a*. The walls 106, 107, 108, 109a and flap 110 are connected by fold lines 112, 113, 114 and 115, respectively. The bottom wall 106 is divided into two sections by a fold line 95*a* which enables the support 151*a* to be lowered into the solid line position depicted in FIG. 11 or raised into the phantom line position there illustrated. The flap 110 and the bottom wall 106 are secured to the bottom wall 120 of the tray 100*a* by welding both the flap 110 and the end 97*a* of the bottom wall 106 to the bottom wall 120 at point 98*a*. In this manner, the bottom wall 106 is divided into two sections differentiated by the fold line or hinge 95*a* which enables the block to be moved between the two positions depicted in FIG. 11. This embodiment presents: (a) a more positive means for attaching the foam block than that of FIG. 10**; (b) does not require a gluing operation in the manufacture; and (c) provides a reliable means for preventing the block from becoming detached from the sheet.

Three illustrated versions of the preferred embodiment of the invention have been described. In each, the supports are pivotally movable to enable the reusable trays to stack or nest.

Having described the preferred embodiments of the invention, the following is what is claimed:

1. A nestable, stackable tray comprising:

a rectangular base, four walls, one secured to and upstanding from each of the edges of said base and tapered outwardly therefrom, and a pair of stacking supports each pivotally secured at the bottom of one of an opposite pair of said walls, and movable between (a) a lowered position against said base for presenting an upwardly facing, load bearing surface for supporting a like tray from said load bearing surface and engaged with said load bearing surface and nested within said tray and (b) a raised position against said one of said walls for supporting another like tray stacked thereon.

2. The tray of claim 1 further comprising a pair of fasteners each connected between one of said supports and the respective wall of said pair for holding said support against said wall when said support is in said raised position.

3. The tray of claim 2 wherein each of said fasteners comprises Velcro fastener means attached between said support and said wall.

4. A nestable, stackable tray comprising a rectangular base and four walls each upstanding from a different one of the edges of said base and tapered outwardly therefrom, and said tray having a stacking support pivotally secured to the inside thereof, and movable between (a) a lowered position against said base to present an upwardly facing, load bearing surface on said stacking support to support from said stacking support and in spaced relationship with said base another one of said trays for nesting said tray therewith, and (b) a raised position against one of said walls for supporting another one of said trays for stacking thereupon.

5. A nestable, stackable tray formed of at least one piece of die cut flat sheet material and comprising:

a rectangular base formed of a piece of said sheet material, a pair of side walls each formed from a piece of said sheet material and upstanding and tapered outwardly from and secured to a different one of the opposing side edges of said base, a pair of end walls each formed from a piece of said sheet material and upstanding and tapered outwardly from and secured to a different one of the opposing end edges of said base, a pair of stacking supports each pivotally secured at the inside of said tray along a different one of the walls of one of said pair and formed integrally of one of said pieces of sheet material, and each of said supports being so secured at a fold in said material and movable between (a) a lowered position against said base to present an upwardly facing, load bearing surface on said lowered support for supporting a like tray engaged with said load bearing surface and said tray, and (b) a raised position against one of said walls for supporting another one of said trays for stacking thereupon.

6. The tray of claim 5 formed of three pieces of die cut sheet material wherein:

said base and one of said pair of walls are integrally formed of a first one of said pieces, one of the walls of said other pair and one of said supports are integrally formed of a second one of said pieces, and the other one of the walls of said other pair and the other one of said supports are integrally formed of a third one of said pieces.

7. The tray of claim 5 further comprising a pair of fasteners each connected between one of said supports and the respective wall of said tray for holding said support against said wall when said support is in said raised position.

8. The tray of claim 5 wherein the movable portions of said second and third pieces of sheet material are each folded into a closed loop, and wherein said supports each comprises a support block formed of one of said closed loops of sheet material.

9. The tray of claim 8 wherein said closed loops have a triangular shape.

10. The tray of claim 8 wherein each of said loops defines a shape having a first surface for supporting another one of said trays for stacking when said support is in said raised position, and a second surface for supporting another one of said trays in spaced relationship with said tray for nesting therewith when said support is in said lowered position.

11. The tray of claim 10 wherein said second surface rests against one of said walls when said support is in said raised position and wherein said shape has a third surface which rests against said base when said support is in said lowered position.

12. The tray of claim 10 wherein said tray comprises a pair of fasteners, one connected between each of said second surfaces and said one of said walls for holding said supports in said raised position.

* * * * *